United States Patent [19]

Kolaska et al.

[11] 4,276,096

[45] Jun. 30, 1981

[54] METHOD FOR PRODUCING HARD METAL BODIES OF INCREASED WEAR RESISTANCE

[75] Inventors: Johannes Kolaska, Bottrop; Hans Grewe, Grefrath, both of Fed. Rep. of Germany

[73] Assignee: Fried. Krupp Gesellschaft mit beschränkter Haftung, Essen, Fed. Rep. of Germany

[21] Appl. No.: 114,313

[22] Filed: Jan. 22, 1980

Related U.S. Application Data

[63] Continuation of Ser. No. 887,812, Mar. 17, 1978, abandoned.

[30] Foreign Application Priority Data

Apr. 22, 1977 [DE] Fed. Rep. of Germany ..... 2717842

[51] Int. Cl.[3] ..... C21D 1/48

[52] U.S. Cl. ..... 148/16.6; 75/200; 75/203; 75/205; 75/224; 75/226; 75/238; 148/31.5

[58] Field of Search ..... 75/200, 205, 224, 203, 75/226, 238; 148/126, 31.5, 16.6; 887/812

[56] References Cited

U.S. PATENT DOCUMENTS

| | | | |
|---|---|---|---|
| 2,596,981 | 5/1952 | Chenault et al. | 148/16.6 |
| 3,368,882 | 2/1968 | Ellis et al. | 148/31.5 |
| 3,854,991 | 12/1974 | Hale | 428/336 |
| 3,999,954 | 12/1976 | Kolaska et al. | 29/182.7 |
| 4,019,873 | 4/1977 | Reiter | 428/217 |

FOREIGN PATENT DOCUMENTS

| | | |
|---|---|---|
| 314212 | 3/1974 | Austria . |
| 331049 | 7/1976 | Austria . |
| 1304291 | 1/1973 | United Kingdom . |
| 1437069 | 5/1976 | United Kingdom . |

OTHER PUBLICATIONS

Metals Handbook 8th ed. vol. a, Heat Treating, Cleaning and Finishing, American Society for Metals 1964, pp. 161–162.

Rüdiger et al., "Verschleiss-Schutzschichten auf Hartmetablen" pp. 267–282, May 1977, *Wear.*

VDI-Z 99, No. 36, Dec. 21st (1957).

*Primary Examiner*—L. Dewayne Rutledge
*Assistant Examiner*—John P. Sheehan
*Attorney, Agent, or Firm*—Spencer & Kaye

[57] ABSTRACT

Method for producing a hard metal body having increased wear resistance, the body containing at least one of the binder metals iron, cobalt and nickel and at least one carbide of the elements titanium, zirconium, hafnium, vanadium, niobium, tantalum, chromium, molybdenum and tungsten, the body being produced by way of sintering and having a nitrogen containing surface, comprises subjecting a hard metal body containing the binder metal and carbide to a pressure between 2 bar and 5000 bar in a sintering autoclave at a high temperature and in a nitrogen containing atmosphere, after final sintering, to enrich the hard metal body with nitrogen and to form the nitrogen containing surface.

5 Claims, No Drawings

METHOD FOR PRODUCING HARD METAL BODIES OF INCREASED WEAR RESISTANCE

CROSS REFERENCE TO RELATED APPLICATION

This application is a continuation of Applicants' copending United States Application Ser. No. 887,812, filed Mar. 17th, 1978 abandoned.

BACKGROUND OF THE INVENTION

The present invention relates to hard metal bodies having increased wear resistance and to a method for producing them. The hard metal bodies include at least one of the binder metals iron, cobalt and nickel and at least one carbide of the elements titanium, zirconium, hafnium, vanadium, niobium, tantalum, chromium, molybdenum and tungsten and contain nitrogen in their surfaces.

It has long been known that hard metal bodies can be formed from at least one binder or bonding metal of iron, cobalt and nickel and at least one hard metal refractory carbide of at least one of the elements titanium, zirconium, hafnium, vanadium, niobium, tantalum, chromium, molybdenum and tungsten. The hard metal body generally is formed by uniting a powdered form of the hard metal carbide by compression with the binding metal, followed by sintering. In some instances, the forming of the hard metal body includes a presintering step at low temperatures (e.g. about 800° C.) to give it sufficient strength to be ground or cut to more complex shapes than can be formed by pressing. Final sintering is then carried out at a much higher temperature, specific for each composition. During the final sintering process, whether or not it follows a presintering step, the product generally receives its final shape and dimensions and the resulting sintered product is a molded, shaped, hard metal body which often is referred to as a cemented carbide. The hard metal bodies possess great hardness and find wide application in metal turning and cutting tools which are hard enough to permit high turning and cutting speeds in rock or metal.

Increasing demands have been placed on hard metal bodies and there has been a continuing search to provide hard metal bodies having still greater wear resistance. To this end, there has been produced hard metal bodies comprising a core of a shaped, hard metal body formed from a hard metal carbide and bonding metal as described above and a surface coating of a hard material on the core. In particular, it is known to provide hard metal bodies with a surface coating of hard material, such as with a coating of carbides, nitrides, carbonitrides, borides and/or oxides so as to significantly increase their hardness at their surfaces. The surface coating of hard material generally is formed by deposition on the core of the hard metal body during a separate process step. For example, deposition from the gaseous phase according to the chemical vapor deposition (CVD) process is a preferred method for forming a surface coating on a hard metal body. The application of one or more surface layers has been effected, for example, as described in German Offenlegungsschrift No. 24 33 737 corresponding to U.S. Pat. No. 3,999,954 and German Offenlegungsschrift No. 25 25 185 corresponding to U.S. Pat. No. 4,019,873, by means of a CVD process (chemical vapor deposition) or a PVD process (physical vapor deposition), in a separate process step. These coated hard metal bodies are produced by forming a coating on an already formed hard metal body and thus have the drawback that an additional process step for the coating is required in their manufacture. A further drawback of these coated hard metal bodies is their low thermal stress resistance. Due to the different coefficients of expansion of the basic body substrate (core of hard metal body) and the vapor-deposited surface material, intensive heating produces stresses which may in the end result in the surface coating coming loose from the basic body.

In view of these facts, the hard metal bodies produced according to the above-mentioned processes can withstand high toughness stresses only conditionally. The easy detachment of such vapor-deposited coatings generally leads to a limitation of the maximum possible thickness of the surface layer of 15$\mu$.

Austrian Patent No. 314,212 claims a process according to which the alloys are treated for the duration of the sintering process under a gas pressure of 2 to 500 bar, preferably 20 to 200 bar, in gases which can either be inert gases or which are required, inter alia, for the alloy formation. The hard metals produced according to this process may, however, have an unfavorable structure configuration. A further drawback of this process is the increased sintering temperature.

Austrian Patent No. 331,049 discloses nitration of the surface of hard metal bodies by diffusing nascent nitrogen into the surface of the molded body. This nascent nitrogen is produced by splitting ammonia at 550° C. or by catalytically splitting molecular nitrogen at 1000° C. Nitrogen enrichment of the hard metal surface is also possible according to Austrian Patent No. 331,049 by effecting treatment in a molten sodium cyanide and sodium cyanate salt bath or a potassium cyanide and potassium cyanate salt bath at 550° to 600° C. Such nitrogen enrichment under normal pressure must be effected in a second process step after formation of the hard metal body, which is a drawback.

SUMMARY OF THE INVENTION

It is a primary object of the present invention to provide a method for producing hard metals having nitride containing surface layers with wear properties which are superior to those of the prior art substances.

A further object of the present invention is to provide improved hard metal bodies.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention as embodied and broadly described, provides a method for producing a hard metal body having increased wear resistance, the body containing at least one of the binder metals iron, cobalt and nickel and at least one carbide of the elements titanium, zirconium, hafnium, vanadium, niobium, tantalum, chromium, molybdenum and tungsten, the body being produced by way of sintering and having a nitrogen containing surface, comprising subjecting a hard metal body containing the binder metal and carbide to a pressure between 2 bar and 5000 bar in a sintering autoclave at a high temperature and in a nitrogen containing atmosphere, after final sintering, to enrich the hard metal body with nitrogen and to form the nitrogen containing surface.

It is to be understood that both the foregoing general description and the following detailed description are exemplary but are not restrictive of the invention.

DETAILED DESCRIPTION OF THE INVENTION

The hard metal body of the present invention contains a core of a hard metal body. The hard metal body core contains at least one carbide suitable as a hard material and at least one binder metal. The term "carbide" as used in the present application generally refers to a carbide of the type normally used in preparing high-strength cutting materials and includes one or more of the metal carbides of tungsten, titanium, tantalum, niobium, vanadium, zirconium, hafnium and molybdenum. The binder metal used in the core generally is at least one metal selected from the group iron, cobalt and nickel. The relative proportions of carbide and binder metal depend on the end use of the product, and generally, the binder can comprise from about 5 to about 20% of the core for hard metal bodies intended for use as cutting tools. As will be apparent, other proportions can be used. A typical cemented carbide core contains tungsten carbide as the metal carbide and cobalt as the binder metal.

In the practice of the present invention, a nitrogen containing surface layer of the hard metal body is formed. The nitrogen containing surface layer is produced by subjecting the hard metal body, after the final sintering of the hard metal body, to a nitrogen enrichment treatment. The nitrogen enrichment treatment comprises subjecting the hard metal body to a pressure between 2 bar and 5000 bar in a sintering autoclave at a high temperature and in a nitrogen containing atmosphere.

Preferably, the pressure for the nitrogen containing atmosphere is selected to be between 50 to 2000 bar and the temperature for the nitrogen enrichment treatment is between 800° C. and an upper limit which lies at least 50° C. below the maximum sintering temperature.

Hard metal bodies are usually sintered at temperatures between 1400° and 1500° C., so that after the final sintering the temperature for the nitrogen enrichment treatment is between 800° and 1350° C., or between 800° and 1450° C.

A preferred temperature-range for the nitrogen enrichment treatment lies between 1100° and 1300° C.

The duration of the nitrogen enrichment treatment of the hard metal body is at least 15 minutes, and preferably it lies between 1 and 10 hours. The nitrogen enrichment is effected depending on requirements, either directly after the final sintering during the cooling process in the sintering autoclave or in a second process cycle.

The pressure treatment of the hard metal body is advantageously effected in the presence of nitrogen or of nitrogen-noble gas and/or nitrogen-noble gas-$C_nH_m$ and/or nitrogen-$C_nH_m$ and/or nitrogen-carbon monoxide mixtures. The hard metal bodies are particularly wear resistant if the nitrogen content in the surface layers according to the present invention increases from the inside toward the outside. The nitrogen containing surface layer can have a thickness up to 300 μm.

$C_nH_m$ is a chemical combination of saturated or nonsaturated hydrocarbon-gas; preferably there is used an aliphatic hydrocarbon like $C_2H_6$, $C_3H_8$ or $C_4H_{10}$.

In practical use, the hard metal bodies produced according to the process of the present invention, among them hard metal tools, exhibit an advantageously improved wear behavior, an improvement of the oxidation resistance and a reduction in the tendency of the hard metal to diffuse and adhere during its interaction with a wear producing partner.

When the nitrogen enrichment of the molded hard metal bodies is effected only after final sintering during the cooling process, it is possible to sinter in a vacuum. Thus, operation at higher final sintering temperatures is prevented, as are reduced stability and reduced wettability of the nitrides which would result in poorer structure formation.

In contrast to the known state of the art, it is accomplished, in particular, that the properties of the material of which the molded hard metal bodies according to the present invention are made are noticeably improved.

Several examples of the present invention will be described in detail below and their advantageous material properties will be explained.

EXAMPLE 1

A finally at 1400° C. sintered turnover cutting plate SNUN 12 04 08 was treated in accordance with the present invention with nitrogen in a sintering autoclave for 5 hours at 1200° C. under a pressure of 65 bar. The cutting plate was made of the hard metal P 25.

The hard metal P 25 is of the following composition in parts by weight:

70% WC, 20% (Ti, Ta) C, 10% Co SNUN defines the geometric form of the cutting plate i.e. as having a cutting length of 12 mm a thickness of 4 mm and a corner radius of 8/10 mm.

Cutting values during turning in a smooth cut with the hard metal P 25 were determined for the turnover plate produced according to the present invention, and for an identical turnover plate made from the same hard metal P 25, but which had not been treated with nitrogen and which is according to the prior art. The testing, which was effected by turning attempts with both turnover plates in a smooth cut, took place under the following conditions and with the following results:

| Test Conditions for a Smooth Cut With Hard Metal P 25: | |
|---|---|
| Material being cut: | C 60 Steel |
| Cutting speed: | "v" = 160 m/min |
| Cutting depth: | "a" = 1.5 mm |
| Advance: | "s" = 0.25 mm per revolution |
| Turning time: | "t" = 5 min. |
| Performance Results for Smooth Cut: | |
| (a) Untreated turnover cutting plate according to the prior art: | |
| Depth of Crater Wear, KT: 82 μm | |
| Width of Flank Wear, VB: 38 mm | |
| (b) Turnover cutting plate according to the present invention: | |
| Depth of Crater Wear, KT: 46 μm | |
| Width of Flank Wear, VB: 36 mm | |

The results indicate that the cutting plate which had additionally been treated with nitrogen in accordance with the present invention has a substantially lower crater wear.

EXAMPLE 2

Cutting values for a hard metal P 10 were determined during turning with a smooth cut and with an interrupted cut.

The hard metal P 10 is of the following composition in parts by weight:

65% WC, 26% (Ti, Ta) C, 9% Co.

Two identical cutting tools were made from the hard metal P 10, with one cutting tool being subjected to a nitrogen enrichment treatment according to the present invention, and the other cutting tool being untreated according to the prior art. The cutting tool made according to the present invention was finally sintered at 1400° C. and then treated with nitrogen at 1200° C. for 10 hours under a pressure of 65 bar. The individual test conditions and results are shown in the table below:

| Test Conditions during Turning with Smooth Cut with Hard Metall P 10: | |
|---|---|
| Material Being Cut: | C 85 V Steel |
| Cutting speed: | "v" = 140 m/min |
| Cutting depth: | "a" = 1.5 mm |
| Advance: | "s" = 0.25 mm per revolution |
| Turning time: | "t" = 10 min |
| Performance Results for Smooth Cut: | |
| (a) Untreated cutting tool made from prior art material: | |
| Depth of Crater Wear, KT: 88 μm | |
| Width of Flank Wear, VB: 29 mm | |
| (b) Cutting tool of treated cutting material according to the present invention: | |
| Depth of Crater Wear, KT: 34 μm | |
| Width of Flank Wear, VB: 25 mm | |

According to the above, the present example shows an essent improvement in the crater wear during turning with a smooth cut.

To determine whether the wear behavior of the cutting material according to the invention changes with an interrupted cut, four rods were faced with an interrupted cut under the following conditions:

| Test Conditions with Interrupted Cut with Hard Metal P 10: | |
|---|---|
| Material being cut: | C 85 KN Steel |
| Cutting speed: | "v" = 250 m/min |
| Cutting depth: | "a" = 2 mm |
| Advance: | "s" = 0.25 mm per revolution |
| Performance Result for Interrupted Cut: | |
| (a) Untreated cutting tool made from prior art cutting material: | |
| Experiment 1: 23 passages | |
| Experiment 2: 25 passages | |
| (b) Cutting tool of treated cutting material according to the present invention: | |
| Experiment 1: 20 passages | |
| Experiment 2: 31 passages | |

The above performance results show that the nitrogen treatment of the hard metal material as provided by the present invention which exhibits substantially improved crater wear with a smooth cut has practically no influence on the wear behavior with an interrupted cut.

EXAMPLE 3

Cutting values for a hard metal M 15 were determined during turning with a smooth cut.

The hard metal M 15 is of the following composition in parts by weight:

80.5% WC, 13% TiC/TaC, 6.5% Co.

Two identical cutting tools were made from the hard metal M 15, with one cutting tool being subjected to a nitrogen enrichment treatment according to the present invention, and the other cutting tool being untreated according to the prior art. In contrast to Examples 1 and 2, the hard metal body according to the invention was treated with nitrogen directly following the sintering process at 1400° C. during the cooling phase for 10 hours at 1250° C. under a pressure of 100 bar. The individual test conditions and results are shown in the table below. The improvement in the crater wear for the nitrogen treated sample according to the present invention compared to the untreated sample is clearly noticeable.

| Test Conditions for Smooth Cut With Hard Metal M 15: | |
|---|---|
| Material being cut: | GG 350 HB Cast Iron |
| Cutting speed: | "v" = 35 m/min |
| Cutting depth: | "a" = 2 mm |
| Advance: | "s" = 0.38 mm per revolution |
| Cutting time: | "t" =5 min. |
| Performance Results for Smooth cut: | |
| (a) Untreated cutting tool made from prior art cutting material: | |
| Depth of Crater Wear, KT: 54 μm | |
| Width of Flank Wear, VB: 34 mm | |
| (b) Cutting tool of treated cutting material according to the present invention: | |
| Depth of Crater Wear, KT: 11 μm | |
| Width of Flank Wear, VB: 35 mm | |

The test results show for all cutting materials being examined that the hard metal cutting materials produced according to the method of the present invention have clearly improved wear properties compared to the prior art materials.

The examples of the present invention show that nitrogen enrichment treatment immediately following the final sintering during the cooling process, as in Example 3, furnishes a particularly noticeable improvement of the service life behavior, measured in crater wear. Additionally, in Example 3 it was not necessary to treat the cutting material in a second process cycle so that the process of Example 3 can additionally be considered to be particularly economical with a view toward energy savings.

It will be understood that the above description of the present invention is susceptible to various modifications, changes and adaptations, and the same are intended to be comprehended within the meaning and range of equivalents of the appended claims.

What is claimed is:

1. Method for producing a hard metal body having increased wear resistance, the hard metal body containing at least one of the binder metals iron, cobalt and nickel and at least one of the carbides of the elements titanium, zirconium, hafnium, vanadium, niobium, tantalum, chromium, molybdenum and tungsten, and being produced by way of sintering and having a nitrogen containing surface, comprising: directly after a final sintering at a temperature between 1400° C. and 1500° C. of a hard metal body containing the binder metal and carbide, subjecting the body to a cooling cycle to cool the body to a temperature of 800° C. to 1450° C., and at any time after the body has been cooled by at least 50° C. from its final sintering temperature of 1400° C. to 1500° C. and during said cooling cycle, subjecting the body to a pressure between 50 bar and 5000 bar in a sintering autoclave at a temperature between 800° and 1450° C. and in an atmosphere comprising nitrogen, to enrich the hard metal body with nitrogen and to nitride the surface.

2. Method as defined in claim 1 wherein the pressure of the nitrogen atmosphere is between 50 and 2000 bar.

3. Method as defined in claim 1 wherein the enrichment treatment lasts for at least 15 minutes.

4. Method as defined in claim 3 wherein the enrichment treatment duration is between 1 and 10 hours.

5. Method as defined in claim 1 wherein the enrichment treatment of the hard metal body is effected in the presence of nitrogen, or a nitrogen-noble gas mixture, or a nitrogen-noble gas-carbon monoxide mixture, or a nitrogen-noble gas-$C_nH_m$ mixture, or a nitrogen-$C_nH_m$ mixture.

* * * * *